US006130298A

United States Patent [19]

Yamana et al.

[11] Patent Number: 6,130,298

[45] Date of Patent: Oct. 10, 2000

[54] SOIL-RESISTANT FINISH

[75] Inventors: Masayuki Yamana; Ikuo Yamamoto; Mitsuhiro Usugaya; Taro Sano, all of Osaka, Japan

[73] Assignee: Daikin Industries Ltd., Osaka, Japan

[21] Appl. No.: 09/180,894

[22] PCT Filed: May 14, 1997

[86] PCT No.: PCT/JP97/01616

§ 371 Date: Nov. 16, 1998

§ 102(e) Date: Nov. 16, 1998

[87] PCT Pub. No.: WO97/43481

PCT Pub. Date: Nov. 20, 1997

[30] Foreign Application Priority Data

May 16, 1996 [JP] Japan ..... 8-121445

[51] Int. Cl.[7] ..... C08L 27/06; C08L 27/12; C08F 214/06; C08F 214/18; B05D 3/02

[52] U.S. Cl. ..... 525/330.7; 525/331.4; 526/242; 526/243; 427/373; 427/393.4; 524/805; 524/520

[58] Field of Search ..... 525/330.17, 331.4; 526/242, 243; 427/393.4, 373; 524/520

[56] References Cited

U.S. PATENT DOCUMENTS

| | | | |
|---|---|---|---|
| 4,264,484 | 4/1981 | Patel . | |
| 4,728,707 | 3/1988 | Amimoto et al. | 526/243 |
| 5,284,902 | 2/1994 | Huber et al. . | |

FOREIGN PATENT DOCUMENTS

| | | |
|---|---|---|
| 0423565 | 4/1991 | European Pat. Off. . |
| 58-59277 | 4/1983 | Japan . |
| 63-17109 | 4/1988 | Japan . |
| 1-28147 | 6/1989 | Japan . |
| 2-277887 | 11/1990 | Japan . |
| 3-153716 | 7/1991 | Japan . |
| 3-55515 | 8/1991 | Japan . |
| 3-55516 | 8/1991 | Japan . |
| 3-287872 | 12/1991 | Japan . |
| 5-262948 | 10/1993 | Japan . |

*Primary Examiner*—Tae Yoon
*Attorney, Agent, or Firm*—Birch, Stewart, Kolasch & Birch, LLP

[57] ABSTRACT

A stainproof treatment agent containing:

(A) a fluoroalkyl group-containing copolymer having
  (I) a repeating unit derived from a monomer having a fluoroalkyl group,
  (II) a repeating unit derived from a monomer containing no fluorine,
  (III) a repeating unit derived from vinyl chloride, and
  (IV) a repeating unit derived from a crosslinking monomer; and (B) an acrylic copolymer containing no fluorine, has durability so that sufficient water- and oil-repellency as well as stainproof properties are maintained before and after cleaning.

11 Claims, No Drawings

SOIL-RESISTANT FINISH

FIELD OF THE INVENTION

The present invention relates to a stainproof treatment agent. More particularly, the present invention relates to a stainproof treatment agent comprising a specific copolymer having a fluoroalkyl group and a specific blending copolymer. The stainproof treatment agent of the present invention is particularly useful for a carpet.

RELATED ART

In order to impart the water repellency, oil repellency and stainproof properties to textiles (e.g. carpet), various stainproof treatment agents have hitherto been suggested. Japanese Patent Kokoku Publication Nos. 17109/1988, 55515/1991 and 55516/1991 disclose that a stainproof treatment agent comprising a urethane compound and a specific blending copolymer imparts the water repellency, oil repellency and stainproof properties. However, according to these copolymers, the water repellency, oil repellency and stainproof properties after cleaning are insufficient.

Japanese Patent Kokai Publication No. 59277/1983 also discloses a water- and oil-repellent agent comprising a copolymer containing vinyl chloride. The water repellency and oil repellency before and after cleaning are almost the same but the stainproof properties are insufficient.

Japanese Patent Kokoku Publication No. 28147/1989 discloses a composition for treating a carpet, comprising an adipate ester (low molecular weight) and a blending component. However, this composition can not impart sufficient water repellency, oil repellency and stainproof properties after cleaning.

None of stainproof treatment agents, which have hitherto been proposed, can have sufficient water- and oil-repellency as well as stainproof properties before and after cleaning.

SUMMARY OF THE INVENTION

An object of the present invention is to provide a stainproof treatment agent having durability capable of maintaining sufficient water- and oil-repellency and stainproof properties before and after cleaning.

The present invention provides a stainproof treatment agent comprising:

(A) a fluoroalkyl group-containing copolymer having
- (I) a repeating unit derived from a monomer having a fluoroalkyl group,
- (II) a repeating unit derived from a monomer containing no fluorine,
- (III) a repeating unit derived from vinyl chloride, and
- (IV) a repeating unit derived from a crosslinking monomer; and (B) an acrylic copolymer containing no fluorine.

DETAILED DESCRIPTION OF THE INVENTION

The repeating unit (I) is preferably a repeating unit derived from (meth)acrylate having a fluoroalkyl group. The monomer constituting the repeating unit (I) is preferably one represented by the general formula:

$$R_f—R^1—OCOC(R^2)=CH_2$$

wherein $R_f$ is a linear or branched perfluoroalkyl group having 3 to 20 carbon atoms;

$R^1$ is a linear or branched alkylene group having 1 to 20 carbon atoms, a $—SO_2N(R^3)R^4—$ group or a $—CH_2CH(OR^5)CH_2—$ group ($R^3$ is an alkyl group having 1 to 10 carbon atoms; $R^4$ is a linear or branched alkylene group having 1 to 10 carbon atoms; and R5 is a hydrogen atom or an acyl group having 1 to 10 carbon atoms); and $R^2$ is a hydrogen atom or a methyl group.

Examples of the monomer include the followings:

$CF_3(CF_2)_7(CH_2)_{10}OCOCCH=CH_2$,
$CF_3(CF_2)_7(CH_2)_{10}OCOC(CH_3)=CH_2$,
$CF_3(CF_2)_6CH_2OCOCH=CH_2$,
$CF_3(CF_2)_8CH_2OCOC(CH_3)=CH_2$,
$(CF_3)_2CF(CF_2)_6(CH_2)_2OCOCH=CH_2$,
$(CF_3)_2CF(CF_2)_8(CH_2)_2OCOCH=CH_2$,
$(CF_3)_2CF(CF_2)_{10}(CH_2)_2OCOCH=CH_2$,
$(CF_3)_2CF(CF_2)_6(CH_2)_2OCOC(CH_3)=CH_2$,
$(CF_3)_2CF(CF_2)_8(CH_2)_2OCOC(CH_3)=CH_2$,
$(CF_3)_2CF(CF_2)_{10}(CH_2)_2OCOC(CH_3)=CH_2$,
$CF_3CF_2(CF_2)_6(CH_2)_2OCOCH=CH_2$,
$CF_3CF_2(CF_2)_8(CH_2)_2OCOCH=CH_2$,
$CF_3CF_2(CF_2)_{10}(CH_2)_2OCOCH=CH_2$,
$CF_3CF_2(CF_2)_6(CH_2)_2OCOC(CH_3)=CH_2$,
$CF_3CF_2(CF_2)_8(CH_2)_2OCOC(CH_3)=CH_2$,
$CF_3CF_2(CF_2)_{10}(CH_2)_2OCOC(CH_3)=CH_2$,
$CF_3(CF_2)_7SO_2N(CH_3)(CH_2)_2OCOCH=CH_2$,
$CF_3(CF_2)_7SO_2N(C_2H_5)(CH_2)_2OCOCH=CH_2$,
$(CF_3)_2CF(CF_2)_8CH_2CH(OCOCH_3)CH_2OCOC(CH_3)=CH_2$ and
$(CF_3)_2CF(CF_2)_6CH_2CH(OH)CH_2OCOCH=CH_2$, but are not limited thereto.

The repeating unit (II) is preferably derived from a vinyl monomer containing no fluorine. Examples of the preferable monomer constituting the repeating unit (II) include ethylene, vinyl acetate, halogenated vinylidene, acrylonitrile, styrene, alkyl (meth)acrylate, polyethylene glycol (meth)acrylate, polypropylene glycol (meth)acrylate, methoxypolyethylene glycol (meth)acrylate, methoxypolypropylene glycol (meth)acrylate, vinyl alkyl ether and isoprene, but are not limited thereto.

The monomer constituting the repeating unit (II) may be a (meth)acrylate ester having an alkyl group. The number of carbon atoms of the alkyl group may be from 1 to 30, e.g. from 6 to 30, specifically from 10 to 30. For example, the monomer constituting the repeating unit (II) may be acrylate esters represented by the general formula:

$$CH_2=CA^1COOA^2$$

wherein $A^1$ is a hydrogen atom or a methyl group; and $A^2$ is an alkyl group represented by $C_nH_{2n+1}$(n=1–30). By copolymerizing these monomers, the water- and oil-repellency and stainproof properties as well as various characteristics (e.g. cleaning resistance, washing resistance and wear resistance of these properties, solubility in solvent, hardness and feeling) can be improved according to necessity.

The crosslinking monomer constituting the repeating unit (IV) may be a vinyl monomer which has at least two reactive groups but contains no fluorine. The crosslinking monomer may be a compound having at least two carbon-carbon double bonds, or a compound having at least one carbon-carbon double bond and at least one reactive group.

Examples of the crosslinking monomer include diacetone acrylamide, (meth)acrylamide, N-methylolacrylamide, hydroxymethyl (meth)acrylate, hydroxyethyl (meth) acrylate, 3-chloro-2-hydroxypropyl (meth)acrylate, N,N-dimethylaminoethyl (meth)acrylate, N,N-diethylaminoethyl (meth)acrylate, butadiene, chloroprene and glycidyl (meth) acrylate, but are not limited thereto. By copolymerizing these monomers, the water- and oil-repellency and stainproof properties as well as various characteristics (e.g. cleaning resistance and washing resistance of these properties, solubility in solvent, hardness and feeling) can be improved according to necessity.

The weight-average molecular weight of the copolymer (A) is preferably from 2,000 to 1,000,000.

The amount of the repeating unit (I) is preferably from 30 to 90% by weight, more preferably from 40 to 90% by weight, particularly from 50 to 80% by weight; the amount of the repeating unit (II) is preferably from 4 to 60% by weight, more preferably from 5 to 60% by weight, particularly from 10 to 40% by weight; the amount of the repeating unit (III) is preferably from 5 to 50% by weight, more preferably from 10 to 40% by weight; and the amount of the repeating unit (IV) is preferably from 0.1 to 10% by weight, more preferably from 0.5 to 5% by weight; based on the copolymer (A).

The copolymer (B) comprises at least two (meth)acrylic monomers containing no fluorine. The (meth)acrylic monomer containing no fluorine may be one represented by the general formula:

$$CH_2{=}CX^1COOX^2 \quad \text{(i)}$$

wherein X1 is a hydrogen atom or a methyl group; and $X^2$ is a linear or branched alkyl ($C_nH_{2n+1}$) (n=1–5) group.

The copolymer (B) may be a copolymer of a (meth) acrylic monomer wherein $X^2$ is a methyl group (hereinafter referred to as "methyl group-containing (meth)acrylate") (e.g. methyl methacrylate (MMA)) and a (meth)acrylic monomer wherein $X^2$ is an alkyl group having 2 to 5 carbon atoms (hereinafter referred to as "$C_{2-5}$ alkyl group-containing (meth)acrylate") (e.g. ethyl methacrylate (EMA)).

The weight-average molecular weight of the copolymer (B) is from 1,000 to 1,000,000. Preferably, it is from 100,000 to 200,000.

The amount of the methyl group-containing (meth) acrylate is preferably from 10 to 90% by weight, more preferably from 40 to 95% by weight, particularly from 75 to 85% by weight, and the amount of the $C_{2-5}$ alkyl group-containing (meth)acrylate is preferably from 10 to 90% by weight, more preferably from 5 to 60% by weight, particularly from 15 to 25% by weight, based on the copolymer (B) which is a copolymer of the methyl group-containing (meth) acrylate/$C_{2-5}$ alkyl group-containing (meth)acrylate.

In the stainproof treatment agent, the weight ratio of the copolymer (A) to the copolymer (B) is from 1:99 to 99:1.

The copolymers (A) and (B) in the present invention can be normally produced by any polymerization method, and the conditions of the polymerization reaction can also be arbitrarily selected. Examples of the polymerization method include a solution polymerization and an emulsion polymerization. Among them, the emulsion polymerization is particularly preferable.

The method for production of the copolymer (A) will be described in detail.

In the solution polymerization, there can be used a method of dissolving the monomer (I), the monomer (II) and the crosslinking agent (IV) in an organic solvent in the presence of a polymerization initiator, substituting the atmosphere with nitrogen, charging vinyl chloride (III), and heating the mixture with stirring at the temperature within the range from 50 to 120° C. for 1 to 10 hours. Examples of the polymerization initiator include azobisisobutyronitrile, benzoyl peroxide, di-tert-butyl peroxide, lauryl peroxide, cumene hydroperoxide, t-butyl peroxypivalate, and diisopropyl peroxycarbonate. The polymerization initiator may be used in the amount within the range from 0.01 to 5 parts by weight based on 100 parts by weight of the monomer.

The organic solvent is inert to the monomers (I) to (IV) and dissolves them. Examples of the organic solvent include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of the monomers (I) to (IV).

In the emulsion polymerization, there can be used a method of emulsifying the monomer (I), the monomer (II) and the crosslinking monomer (IV) in water in the presence of a polymerization initiator and an emulsifier, substituting the atmosphere with nitrogen, charging vinyl chloride (III), and copolymerizing the monomers with stirring at the temperature within the range from 50 to 80° C. for 1 to 10 hours. As the polymerization initiator, for example, water-soluble initiators (e.g. benzoyl peroxide, lauroyl peroxide, t-butyl perbenzoate, 1-hydroxycyclohexyl hydroperoxide, 3-carboxylpropionyl peroxide, acetyl peroxide, azobisisobutylamidine dihydrochloride, azobisisobutyronitrile, sodium peroxide, potassium persulfate and ammonium persulfate) and oil-soluble initiators (e.g. azobisisobutyronitrile, benzoyl peroxide, di-tert-butyl peroxide, lauryl peroxide, cumene hydroperoxide, t-butyl peroxypivalate, diisopropyl peroxydicarbonate) can be used. The polymerization initiator may be used in the amount within the range from 0.01 to 5 parts by weight based on 100 parts by weight of the monomer.

In order to obtain a copolymer dispersion in water, which is superior in storage stability, it is desirable that the monomers are atomized in water by using an emulsifying device capable of applying a strong shattering energy (e.g. a high-pressure homogenizer and an ultrasonic homogenizer) and then polymerized by using the oil-soluble polymerization initiator. As the emulsifier, various emulsifiers such as an anionic emulsifier, a cationic emulsifier and a nonionic emulsifier can be used in the amount within the range from 0.5 to 10 parts by weight based on 100 parts by weight of the monomers. The anionic and/or nonionic emulsifiers are preferably used. When the monomers (I) to (IV) are not completely compatibilized, a compatibilizing agent capable of sufficiently compatibilizing them (e.g. a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol and ethanol. The organic solvent may be used in the amount within the range from 1 to 50 parts by weight, e.g. from 10 to 40 parts by weight, based on 100 parts by weight of water. Examples of the low-molecular weight monomer include methyl methacrylate, glycidyl methacrylate and 2,2,2-trifluoroethyl methacrylate. The low-molecular weight monomer may be used in the amount within the range from 1 to 50 parts by weight, e.g. from 10 to 40 parts by weight, based on 100 parts by weight of the monomer (I) and monomer (II).

The copolymer (B) can be produced by the procedure which has hitherto been used (or almost the same procedure as in case of the copolymer (A)).

The stainproof treatment agent can be obtained by mixing a liquid containing the copolymer (A) and a liquid containing the copolymer (b), which are separately prepared, and optionally adding a medium (e.g. water and an organic solvent).

The stainproof treatment agent of the present invention can be applied to the surface of a substrate to be treated by the method which has hitherto been known. There can be normally used a method of diluting the stainproof treatment agent with an organic solvent or water, applying the solution to the surface of the substrate to be treated by a known method (e.g. dip coating, spray coating, foam coating, etc. to carpet fabric, carpet yarn or raw fiber) and then drying the substrate. If necessary, the stainproof treatment agent may be applied together with a suitable crosslinking agent, followed by curing. It is also possible to add other water repellents, other oil repellents, mothproofing agents, softeners, antimicrobial agents, flame retardants, antistatic agents, paint fixing agents, crease-proofing agents or the like to the stainproof treatment agent of the present invention and to use them in combination. In case of the dip coating, the concentration of the copolymer in a dipping liquid may be from 0.05 to 10% by weight. In case of the spray coating, the concentration of the copolymer in the treatment liquid may be from 0.1 to 5% by weight. A stain blocker may be used in combination. When using the stain blocker, the anionic or nonionic emulsifier is preferably used.

The substrate to be treated with the stainproof treatment agent of the present invention is preferably a textile, particularly a carpet. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semi-synthetic fibers such as rayon and acetate; inorganic fibers such as glass fiber, carbon fiber and asbestos fiber; and a mixture of these fibers. The stainproof treatment agent of the present invention can be suitably used for carpets of nylon or polypropylene because of excellent resistance to a detergent solution and brushing (mechanical).

The textile may be in any form such as fiber, yarn and fabric. When the carpet is treated with the stainproof treatment agent of the present invention, the carpet may be formed after treating fibers or yarns with the stainproof treatment agent, or the formed carpet may be treated with the stainproof treatment agent. Examples of the substrate to be treated with the stainproof treatment agent of the present invention include glass, paper, wood, hide, fur, asbestos, brick, cement, metal and oxide, ceramics, plastic, coated surface and plaster, in addition to the textile.

PREFERRED EMBODIMENT OF THE INVENTION

The present invention will be illustrated by the following Examples which do not limit the present invention.

The stainproof treatment agents obtained in the Examples and Comparative Examples were evaluated as follows. Each emulsion obtained in the Examples and Comparative Examples was diluted with water to prepare a liquid having a solid content of 3%, which is taken as a treatment liquid. This treatment liquid is sprayed on a nylon loop-pile carpet fabric (non-backed product) so that a treatment amount is 100 g/m$^2$, and the treated carpet fabric is dried by heating at 130° C. for 7 minutes. The water repellency, oil repellency and stainproof properties before and after cleaning test are evaluated. An evaluation method of the water repellency, oil repellency and stainproof properties shown in the Examples and Comparative Examples, and a cleaning test method are as follows:

The water repellency is expressed by the water repellency No. (cf. the following Table 1) determined by the spray method according to JIS (Japanese Industrial Standard)-L-1092.

The oil repellency is determined by dropping several drops (diameter: about 4 mm) of a test solution shown in AATCC-TM-118-1966 (Table 2) on two positions of the surface of a test cloth and observing the penetration state of the drops after 30 seconds. A maximum point of the oil repellency given by the test solution causing no penetration is taken as the oil repellency.

As to the stainproof properties, a carpet is stained with a dry soil having the composition shown in Table 3 according to JIS 1023-1922. After the excess dry soil on the surface is sucked with an electrical cleaner, brightness of the surface is measured by a colorimeter and a stain degree is calculated from the following equation, which is taken for evaluation of dry soil stainproof properties.

$$\text{Stainproof degree (\%)}=[(L_0-L)/L_0]\times 100$$

wherein $L_0$: brightness before staining, L: brightness after staining.

The oil repellency in case of treating a carpet was evaluated in the same manner as in treating a usual fiber.

The cleaning test was conducted according to the method described in JIS-L-1023-1992.

TABLE 1

| Water repellency No. | State |
|---|---|
| 100 | No wet on the surface |
| 90 | Slight wet on the surface |
| 80 | Partial wet on the surface |
| 70 | Wet on the surface |
| 50 | Wet over the whole surface |
| 0 | Complete wet on the front and back surfaces |

TABLE 2

| Oil repellency | Test solution | Surface tension (dyne/cm, 25° C.) |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Hexadecane/Nujol mixture (35/65 by weight) | 29.6 |
| 1 | Nujol | 31.2 |
| 0 | Inferior to 1 | — |

TABLE 3

| Components | Weight ratio (%) |
|---|---|
| Peat moss | 40 |
| Portland cement (JIS R 5210) | 17 |
| White clay (JIS K 8746) | 17 |
| Diatomaceous earth(JIS K 8330) | 17 |
| Carbon black (JIS K 5107) | 0.1 |
| Iron (III) oxide for ferrite (JIS K 1462) | 0.15 |
| Nujol | 8.75 |

PREPARATIVE EXAMPLE 1

(vinyl chloride-containing FA/StA copolymer anionic emulsion+blending emulsion)

$CH_2{=}CHCOO(CH_2)_2(CF_2CF_2),CF_2CF_3$ (FA, a mixture wherein a weight ratio of compounds having n of 3, 4 and 5 is 5:3:1), stearyl acrylate (StA), 2-hydroxyethyl methacrylate (2EHA), diacetone acrylamide (DAAM, crosslinking monomer), 3-chloro-2-hydroxypropyl methacrylate (Topolene M), deionized water, n-laurylmercaptan (LSH, chain transfer agent), ammonium polyoxyethylene alkyl phenyl ether sulfate (Hitenol N-17, anionic emulsifier), polyoxyethylene alkyl phenyl ether (Nonion HS-220, nonionic emulsifier), polyoxyethylene sorbitan monolaurate (Nonion LT-221, nonionic emulsifier) and dipropylene glycol monomethyl ether (DPM) were mixed in the amount shown in Table 4 to prepare a mixture liquid.

This mixture liquid was heated to 60° C. and emulsified by a high-pressure homogenizer. The resulting emulsion was charged in a 1 L autoclave and the dissolved oxygen was removed by substitution with nitrogen. Then, vinyl chloride (VC1) having a purity of 99% was charged in the amount shown in Table 4 and ammonium persulfate (APS) as an initiator was charged in the amount shown in Table 4. Under stirring, the copolymerization reaction was conducted at 60° C. for 8 hours to give a vinyl chloride-containing copolymer emulsion having a solid content of 33% by weight.

A gas chromatography analysis revealed that at least 99% of monomers were polymerized.

An emulsion (solid content: 45% by weight) of a MMA/EMA copolymer, wherein a weight ratio of MMA to EMA is 80:20 and a weight-average molecular weight of the copolymer is 180,000 (in terms of polystyrene), was used as a blending emulsion.

The resulting vinyl chloride-containing copolymer emulsion and the blending emulsion (a copolymer emulsion of methyl methacrylate (MMA)/ethyl methacrylate (EMA)) were blended so that a weight ratio of solid content of each emulsion was 1:1.

PREPARATIVE EXAMPLE 2

(vinyl chloride-containing FA/StA copolymer nonionic emulsion+blending emulsion)

$CH_2{=}CHCOO(CH_2)_2(CF_2CF_2)_nCF_2CF_3$ (FA, a mixture wherein a weight ratio of compounds having n of 3, 4 and 5 is 5:3:1), stearyl acrylate (StA), 2-hydroxyethyl methacrylate (2EHA), diacetone acrylamide (DAAM), 3-chloro-2-hydroxypropyl methacrylate (Topolene M), deionized water, n-laurylmercaptan (LSH), polyoxyethylene alkyl phenyl ether (Nonion HS-220, nonionic emulsifier), polyoxyethylene sorbitan monolaurate (Nonion LT-221, nonionic emulsifier) and dipropylene glycol monomethyl ether (DPM) were mixed in the amount shown in Table 4 to prepare a mixture liquid.

This mixture liquid was heated to 60° C. and emulsified by a high-pressure homogenizer. The resulting emulsion was charged in a 1 L autoclave and the dissolved oxygen was removed by substitution with nitrogen. Then, vinyl chloride (VC1) having a purity of 99% was charged in the amount shown in Table 4 and ammonium persulfate (APS) as an initiator was charged in the amount shown in Table 4. Under stirring, the copolymerization reaction was conducted at 60° C. for 8 hours to give a vinyl chloride-containing copolymer emulsion having a solid content of 33% by weight.

A gas chromatography analysis revealed that at least 99% of monomers were polymerized.

The resulting vinyl chloride-containing copolymer emulsion and the blending emulsion (copolymer emulsion of methyl methacrylate (MMA)/ethyl methacrylate (EMA)) used in Preparation Example 1 were blended so that a weight ratio of solid content of each emulsion was 1:1.

PREPARATIVE EXAMPLE 3

(vinyl chloride-containing FA/StA copolymer cationic emulsion +blending emulsion)

$CH_2{=}CHCOO(CH_2)_2(CF_2CF_2)_nCF_2CF_3$ (FA, a mixture wherein a weight ratio of compounds having n of 3, 4 and 5 is 5:3:1), stearyl acrylate (StA), 2-hydroxyethyl methacrylate (2EHA), diacetone acrylamide (DAAM), 3-chloro-2-hydroxypropyl methacrylate (Topolene M), deionized water, n-laurylmercaptan (LSH), octadecyltrimethylammonium chloride (Cation AB, cationic emulsifier), polyoxyethylene alkyl phenyl ether (Nonion HS-220, nonionic emulsifier), polyoxyethylene sorbitan monolaurate (Nonion LT-221, nonionic emulsifier) and dipropylene glycol monomethyl ether (DPM) were mixed in the amount shown in Table 4 to prepare a mixture liquid.

This mixture liquid was heated to 60° C. and emulsified by a high-pressure homogenizer. The resulting emulsion was charged in a 1 L autoclave and the dissolved oxygen was removed by substitution with nitrogen. Then, vinyl chloride (VC1) having a purity of 99% was charged in the amount shown in Table 4 and ammonium persulfate (APS) as an initiator was charged in the amount shown in Table 4. Under stirring, the copolymerization reaction was conducted at 60° C. for 8 hours to give a vinyl chloride-containing copolymer emulsion having a solid content of 33% by weight.

A gas chromatography analysis revealed that at least 99% of monomers were polymerized.

The resulting vinyl chloride-containing copolymer emulsion and the blending emulsion (copolymer emulsion of methyl methacrylate (MMA)/ethyl methacrylate (EMA)) used in Preparation Example 1 were blended so that a weight ratio of solid content of each emulsion was 1:1.

COMPARATIVE PREPARATIVE EXAMPLE 1

(vinyl chloride-containing FA/StA copolymer anionic emulsion)

$CH_2{=}CHCOO(CH_2)_2(CF_2CF_2)_nCF_2CF_3$ (FA, a mixture wherein a weight ratio of compounds having n of 3, 4 and 5 is 5:3:1), stearyl acrylate (StA), 2-hydroxyethyl methacrylate (2EHA), diacetone acrylamide (DAAM), 3-chloro-2-hydroxypropyl methacrylate (Topolene M), deionized water, n-laurylmercaptan (LSH), ammonium polyoxyethylene alkyl phenyl ether sulfate (Hitenol N-17, anionic emulsifier), polyoxyethylene alkyl phenyl ether (Nonion HS-220, nonionic emulsifier), polyoxyethylene sorbitan monolaurate (Nonion LT-221, nonionic emulsifier) and dipropylene glycol monomethyl ether (DPM) were mixed in the amount shown in Table 4 to prepare a mixture liquid.

This mixture liquid was heated to 60° C. and emulsified by a high-pressure homogenizer. The resulting emulsion was charged in a 1 L autoclave and the dissolved oxygen was removed by substitution with nitrogen. Then, vinyl chloride (VC1) having a purity of 99% was charged in the amount shown in Table 4 and ammonium persulfate (APS) as an initiator was charged in the amount shown in Table 4. Under stirring, the copolymerization reaction was conducted at 60° C. for 8 hours to obtain a vinyl chloride-containing copolymer emulsion having a solid content of 33% by weight.

A gas chromatography analysis revealed that at least 99% of monomers were polymerized.

COMPARATIVE PREPARATIVE EXAMPLE 2

(FA/StA copolymer anionic emulsion containing no vinyl chloride+blending emulsion)

$CH_2{=}CHCOO(CH_2)_2(CF_2CF_2)_nCF_2CF_3$ (FA, a mixture wherein a weight ratio of compounds having n of 3, 4 and 5 is 5:3:1), stearyl acrylate (StA), 2-hydroxyethyl methacrylate (2EHA), N-methylolacrylamide (NMAM), 3-chloro-2-hydroxypropyl methacrylate (Topolene M), deionized water, n-laurylmercaptan (LSH), ammonium polyoxyethylene alkyl phenyl ether sulfate (Hitenol N-17, anionic emulsifier), polyoxyethylene alkyl phenyl ether (Nonion HS-220, nonionic emulsifier), polyoxyethylene sorbitan monolaurate (Nonion LT-221, nonionic emulsifier) and dipropylene glycol monomethyl ether (DPM) were mixed in the amount shown in Table 4 to prepare a mixture liquid.

This mixture liquid was heated to 60° C. and emulsified by a high-pressure homogenizer. The resulting emulsion was charged in a four-necked flask equipped with a reflux condenser, a nitrogen introducing tube, a thermometer and a stirring device and the dissolved oxygen was removed by substitution with nitrogen. Then, ammonium persulfate (APS) as an initiator was charged in the amount shown in Table 4. Under stirring, the copolymerization reaction was conducted at 60° C. for 8 hours to give a copolymer emulsion having a solid content of 33% by weight.

A gas chromatography analysis revealed that at least 99% of monomers were polymerized.

The resulting copolymer emulsion and the blending emulsion (copolymer emulsion of methyl methacrylate (MMA)/ethyl methacrylate (EMA)) used in Preparation Example 1 were blended so that a weight ratio of solid content of each emulsion was 1:1.

EXAMPLE 1

(vinyl chloride-containing FA/StA copolymer anionic emulsion+blending emulsion)

The emulsion prepared in Preparative Example 1 was diluted with water to prepare a liquid having a solid content of 3%, which was taken as a treatment liquid. This treatment liquid was sprayed on a nylon pile carpet fabric (non-backed product) so that a treatment amount was 100 g/m$^2$, and the treated carpet fabric was dried by heating at 130° C. for 7 minutes. The water repellency, oil repellency and stainproof properties were evaluated before and after cleaning. The results are shown in Table 5.

EXAMPLE 2

(vinyl chloride-containing FA/StA copolymer nonionic emulsion+blending emulsion)

The water repellency, oil -repellency and stainproof properties before and after cleaning of the emulsion prepared in Preparative Example 2 were evaluated in the same manner as in Example 1. The results are shown in Table 5.

EXAMPLE 3

(vinyl chloride-containing FA/StA copolymer cationic emulsion+blending emulsion)

The water repellency, oil repellency and stainproof properties before and after cleaning of the emulsion prepared in Preparative Example 3 were evaluated in the same manner as in Example 1. The results are shown in Table 5.

COMPARATIVE EXAMPLE 1

(vinyl chloride-containing FA/StA copolymer anionic emulsion)

The water repellency, oil repellency and stainproof properties before and after cleaning of the emulsion prepared in Comparative Preparative Example 1 were evaluated in the same manner as in Example 1. The results are shown in Table 5.

COMPARATIVE EXAMPLE 2

(FA/StA copolymer emulsion containing no vinyl chloride +blending emulsion)

The water repellency, oil repellency and stainproof properties before and after cleaning of the emulsion prepared in Comparative Preparative Example 2 were evaluated in the same manner as in Example 1. The results are shown in Table 5.

COMPARATIVE EXAMPLE 3

(blending emulsion)

The blending emulsion (copolymer emulsion of methyl methacrylate (MMA)/ethyl methacrylate (EMA)) used in Preparative Example 1 was diluted with water to prepare a liquid having a solid content of 3%, which was taken as a treatment liquid. The water repellency, oil repellency and stainproof properties before and after cleaning of this treatment emulsion were evaluated in the same manner as in Example 1. The results are shown in Table 5.

TABLE 4

| | Ionic character | Preparative Example 1 Anion | Preparative Example 2 Nonion | Preparative Example 3 Cation | Comparative Preparative Example 1 Anion | Comparative Preparative Example 2 Anion |
|---|---|---|---|---|---|---|
| Monomer composition (g) | FA | 134 | ← | ← | ← | 97 |
| | StA | 37 | ← | ← | ← | 24 |
| | VC1 | 28 | ← | ← | ← | 0 |
| | 2EHA | 3.5 | ← | ← | ← | 24 |
| | DAAM | 1.8 | ← | ← | ← | 0 |
| | NMAM | 0 | 0 | 0 | 0 | 3.9 |
| | Topolene M | 1.8 | ← | ← | ← | 1.7 |
| Emulsifier (g) | Hitenol N-17 | 3.3 | 0 | 0 | 3.3 | 6.6 |
| | HS-220 | 7.9 | 10.3 | 7.9 | ← | 2.2 |
| | LT-221 | 5.3 | 6.2 | 5.3 | ← | 2.8 |
| | Cation AB | 0 | 0 | 11.0 | 0 | 0 |
| Others (g) | LSH | 3.5 | ← | ← | ← | 0.5 |
| | DPM | 44 | ← | ← | ← | 30 |
| | APS | 1.2 | ← | ← | ← | 2.2 |
| | Deionized water | 330 | ← | ← | ← | 350 |

TABLE 5

| | Example 1 | Example 2 | Example 3 | Comparative Example 1 | Comparative Example 2 | Comparative Example 3 |
|---|---|---|---|---|---|---|
| Before cleaning | | | | | | |
| Oil repellency | 4 | 4 | 4 | 4 | 4 | 0 |
| Water repellency | 60 | 60 | 60 | 60 | 40 | 0 |
| Stainproof properties | 18 | 18 | 18 | 22 | 22 | 18 |

TABLE 5-continued

| | Example 1 | Example 2 | Example 3 | Comparative Example 1 | Comparative Example 2 | Comparative Example 3 |
|---|---|---|---|---|---|---|
| After cleaning | | | | | | |
| Oil repellency | 4 | 4 | 4 | 3 | 2 | 0 |
| Water repellency | 60 | 60 | 60 | 50 | 0 | 0 |
| Stainproof properties | 18 | 18 | 18 | 35 | 36 | 25 |

EFFECT OF THE INVENTION

The stainproof treatment agent of the present invention has durability so that sufficient water- and oil-repellency as well as stainproof properties are maintained before and after cleaning.

What is claimed is:

1. A stainproof treatment agent comprising:

(A) a fluoroalkyl group-containing copolymer having (I) a repeating unit derived from a monomer having a fluoroalkyl group, (II) a repeating unit derived from a monomer containing no fluorine, (III) a repeating unit derived from vinyl chloride, and (IV) a repeating unit derived from a crosslinking monomer; and (B) an acrylic copolymer containing no fluorine.

2. The stainproof treatment agent according to claim 1, wherein the monomer constituting the repeating unit (I) is represented by the general formula:

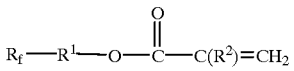

wherein $R_f$ is a linear or branched perfluoroalkyl group having 3 to 20 carbon atoms;

$R^1$ is a linear or branched alkylene group having 1 to 20 carbon atoms, a $—SO_2N(R^3)R^4—$ group or a $—CH_2CH(OR^5)CH_2—$ group ($R^3$ is an alkyl group having 1 to 10 carbon atoms; $R^4$ is a linear or branched alkylene group having 1 to 10 carbon atoms; and $R^5$ is a hydrogen atom or an acyl group having 1 to 10 carbon atoms); and $R^2$ is a hydrogen atom or a methyl group.

3. The stainproof treatment agent according to claim 1, wherein the monomer constituting the repeating unit (II) is acrylates represented by the general formula:

$$CH_2{=}CA^1COOA^2$$

wherein $A^1$ is a hydrogen atom or a methyl group; and $A^2$ is an alkyl group represented by $C_nH_{2n+1}$(n=1–30).

4. The stainproof treatment agent according to claim 1, wherein the copolymer (B) is derived from at least two (meth)acrylic monomers containing no fluorine, and the (meth)acrylic monomer containing no fluorine is represented by the general formula:

$$CH_2{=}CX^1COOX^2$$

wherein $X^1$ is a hydrogen atom or a methyl group; and $X^2$ is a linear or branched $C_nH_{2n+1}$ (n=1–5) group.

5. The stainproof treatment agent according to claim 1, wherein the amount of the repeating unit (I) is from 30 to 90% by weight, the amount of the repeating unit (II) is from 4 to 60% by weight, the amount of the repeating unit (III) is from 5 to 50% by weight, and the amount of the repeating unit (IV) is from 0.1 to 10% by weight, respectively, based on the copolymer (A).

6. The stainproof treatment agent according to claim 1, wherein the copolymer (A) and copolymer (B) are in the form of an aqueous dispersion prepared by dispersing in a medium mainly comprising water.

7. The stainproof treatment agent according to claim 1, wherein the copolymer (A) and copolymer (B) are in the form of an aqueous dispersion prepared by dispersing in a medium mainly comprising water, using nonionic and/or anionic emulsifiers.

8. A method for treating a surface of a substrate with the stainproof treatment agent of claim 1, comprising the steps of:

(i) diluting said stainproof treatment agent with an organic solvent or water to create a solution;

(ii) applying said solution to said surface of a substrate to be treated; and (iii) drying the substrate.

9. The method of claim 8, wherein step (ii) is performed by dip coating, spray coating, foam coating, or a combination thereof.

10. The method of claim 8, wherein said substrate is a textile.

11. The method of claim 10, wherein a form of said textile is a fiber, yarn, fabric, or a combination thereof.

* * * * *